US005209292A

United States Patent [19]

Arneson et al.

[11] Patent Number: 5,209,292

[45] Date of Patent: May 11, 1993

[54] CONDENSER HEADER AND TANK ASSEMBLY WITH INTERFERENCE FIT BAFFLE

[75] Inventors: Dean A. Arneson, Arlington; Clive R. Hindle, Fort Worth, both of Tex.

[73] Assignee: Zexel USA Corporation, Decatur, Ill.

[21] Appl. No.: 884,517

[22] Filed: May 15, 1992

[51] Int. Cl.[5] ..... F28F 9/02

[52] U.S. Cl. ..... 165/176; 165/174; 29/890.052

[58] Field of Search ..... 165/173, 174, 176; 29/890.52

[56] References Cited

U.S. PATENT DOCUMENTS 4,825,941 5/1989 Hoshino et al. ..... 165/110
4,960,169 10/1990 Granetzke ..... 165/173
5,025,855 6/1991 Hoshino et al. ..... 165/150
5,042,578 8/1991 Tanabe ..... 165/174

FOREIGN PATENT DOCUMENTS 2-89998 3/1990 Japan ..... 165/176

*Primary Examiner*—Allen J. Flanigan
*Attorney, Agent, or Firm*—James E. Bradley

[57] ABSTRACT

A parallel flow vehicle air conditioning condenser utilizes baffle plates with an interference fit. The baffle plates locate within header and tank assemblies. Parallel tubes extend between the header and tank assemblies for causing refrigerant flow between the header and tank assemblies and through the tubes. The header and tank assembly is made up of two portions which are brazed together. The baffle plate has abutment edges that abut the interior walls of the two portions in an interference fit to deform the walls and cause sealing.

12 Claims, 4 Drawing Sheets

CONDENSER HEADER AND TANK ASSEMBLY WITH INTERFERENCE FIT BAFFLE

BACKGROUND OF THE INVENTION

1. Field of the Invention

This invention relates in general to heat exchangers, and in particular to an air conditioner condenser of a parallel flow type utilizing baffle plates which locate within the headers in an interference fit.

2. Description of the Prior Art

Parallel flow air conditioner condensers for vehicles utilize a pair of header assemblies with a plurality of parallel tubes extending between the header assemblies. Each header assembly is a conduit providing a flow passage for refrigerant to flow through the tubes. Baffle plates are spaced along each header assemblies at selected points to divert the flow from the header assemblies into certain of the flow tubes.

The baffle plates are secured in the header assemblies by a variety of techniques. In one type of condenser, the header assemblies are assembled from two channels or portions, referred to herein as a header and a tank. Tube slots are formed in the header. Plate slots are pierced both in the tank and in the header. The baffle plates have tabs that extend through the plate slots. Also, shallow recesses or grooves, also called gutters, are formed in the header and tank to receive the abutment edges of the baffle plate.

During assembly of this prior art type, the baffle plate will be placed in the tank or the header. The tabs of the baffle plate will locate in the plate slots. The header and tank are brought together, and crimped. Then the tubes will be inserted in the two headers and the assembly brazed in a furnace. The abutment edges of the baffle plate will fit within the recesses in the interior walls of the header and tank assembly. The recesses serve to enhance sealing between the baffle plate and the interior walls of the header and tank assembly.

While this type of condenser performs well, forming the recesses for the abutment edges of the baffle plate adds expense to the manufacturing and distortion to the header and tank assembly.

SUMMARY OF THE INVENTION

In this invention, the recesses for the abutment edges of the baffle plate are not required. Instead, the baffle plate is oversized slightly relative to the interior walls of the header and tank assembly. The baffle plate will be positioned in the header and tank assembly, with its tabs extending through the plate slots. The two portions are placed in a die and pressed together with enough force to cause the baffle plate abutment edges to deform and imbed in the interior walls of the header and tank assembly. This creates an interference fit and seals the abutment edges to the interior walls. The tubes are subsequently inserted into the tube slots.

DETAILED DESCRIPTION OF THE INVENTION

Figure 1:
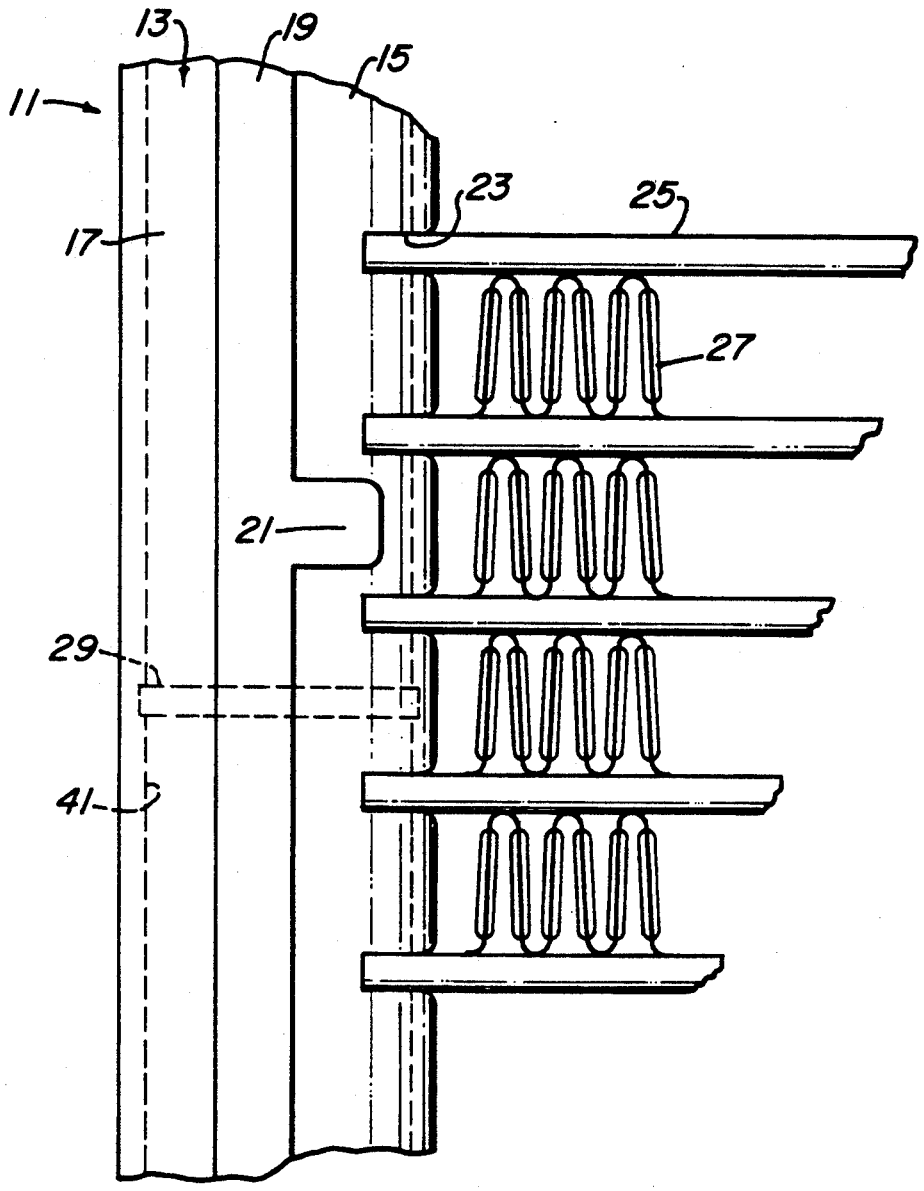
FIG. 1 is a portion of a front view of an air conditioner condenser constructed in accordance with this invention.
Figure 4:
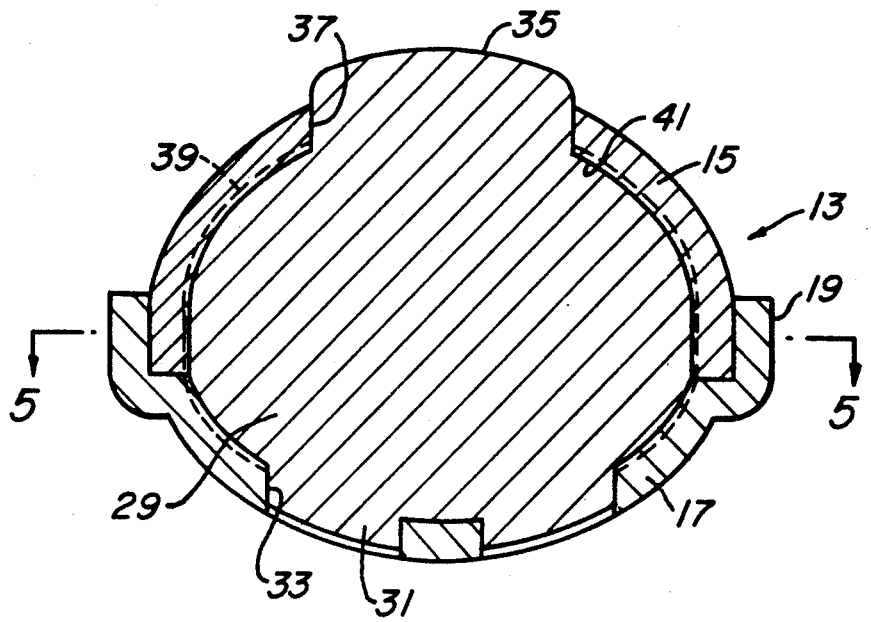
FIG. 4 is a transverse sectional view of the header and tank assembly of FIG. 2, shown assembled.

Referring to FIG. 1, condenser 11 is a parallel flow condenser for use with a vehicle air conditioner. Condenser 11 has two parallel spaced apart header and tank assemblies 13 (only one shown). In the embodiment shown, each header and tank assembly 13 is made up of two channels or portions, referred to herein as a header 15 and a tank 17. As shown in FIG. 4, the two portions 15, 17 create a generally oval or elliptical cross section for header and tank assembly 13 when assembled. Tank 17 has overlapping straight edges 19 which closely receive edges of header 15 when assembled. Tabs 21 extend outward from overlapping edges 19. Tabs 21 are subsequently bent to retain the assembly until brazed in a furnace.

Header 15 has a plurality of tube slots 23 extending axially on its length. Tube slots 23 are elongated apertures extending through the sidewall of header 15. The condenser 11 has a plurality of flat, parallel tubes 25, each having an end that inserts into one of the tube slots 23. Fins 27 are positioned between the tubes 25 to enhance heat exchange.

A number of baffle plates 29, typically one to five, will be positioned axially along the length of each header and tank assembly 13. Each baffle plate 29 is a flow blocking member which blocks the flow through header and tank assembly 13, and diverts it in another direction. Baffle plates 29 will thus cause refrigerant flowing through header and tank assembly 13 to pass through a section of tubes 25 to the opposite header and tank assembly 13 (not shown). Another baffle plate 29 (not shown) in the other header and tank assembly 13 will block the refrigerant flowing in that header and tank assembly 13 and divert it back through another section of tubes 25 to the first header and tank assembly 13. In this manner, the refrigerant flows through sections of tubes 25 in parallel, and in a serpentine fashion due to the positioning of the baffle plates 29.

Figure 2:
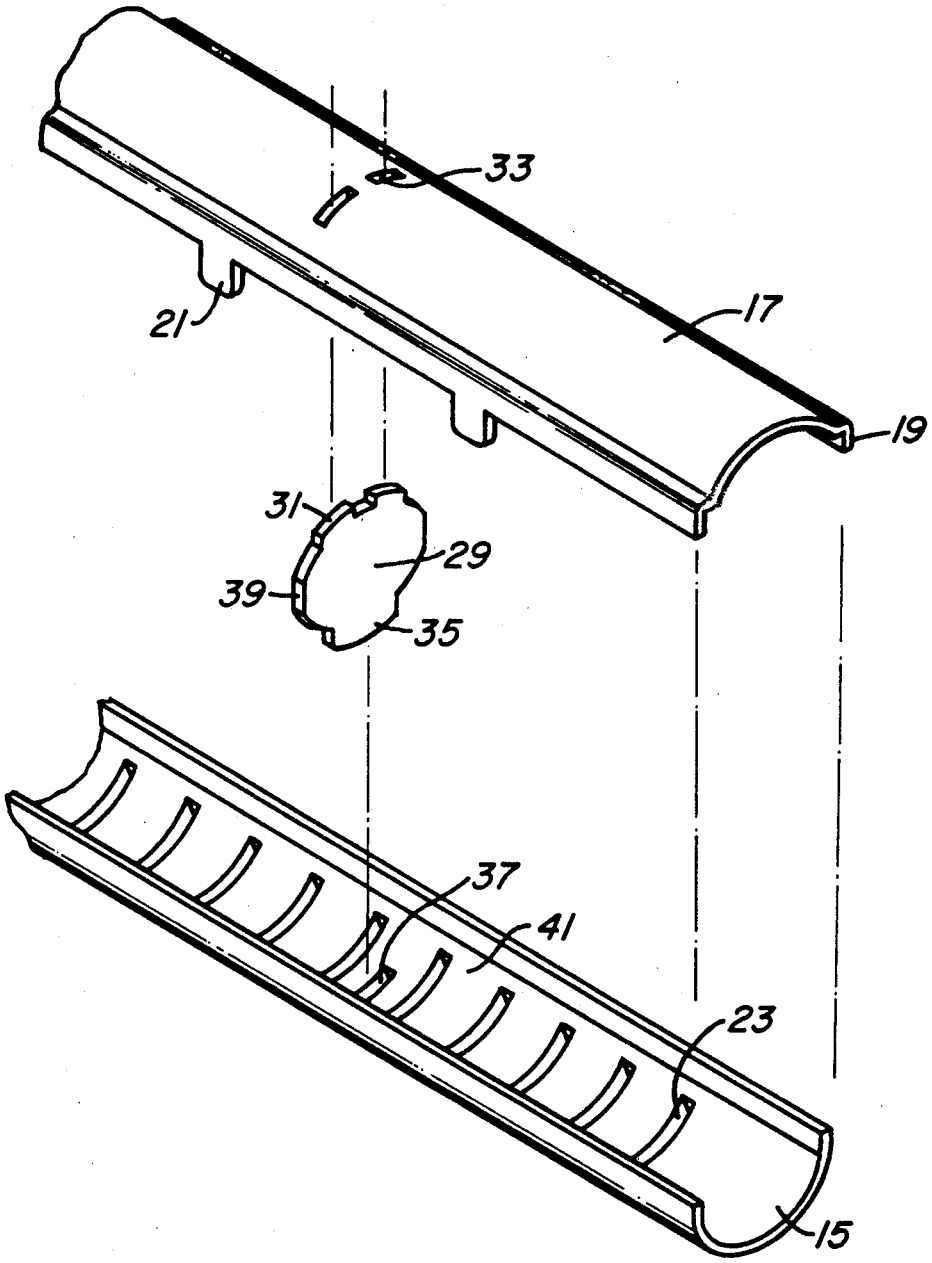
FIG. 2 is an exploded perspective view of one of the header and tank assemblies of the condenser of FIG. 1.

Referring to FIG. 2, each baffle plate 29 is a flat, aluminum plate. Baffle plate 29 has a pair of tank tabs 31 on one edge. Tank tabs 31 are positioned to fit within tank plate slots 33 extending through the wall of the tank 17. In the preferred embodiment, each baffle plate 29 has a header tab 35 on an edge opposite tank tabs 31. Header tab 35 will extend into a header plate slot 37 formed in the header 15. Each header plate slot 37 is formed to be in axial alignment with one of the tank plate slots 33.

Figure 5:
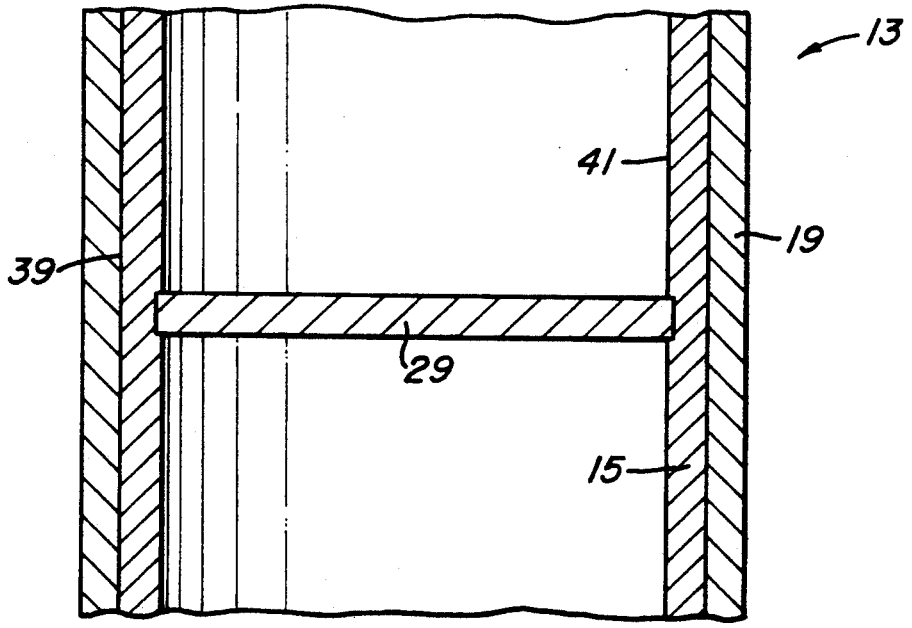
FIG. 5 is a sectional view of the header and tank assembly of FIG. 2, taken along the line 5—5 of FIG. 4.

The baffle plate 29 has an abutment edge 39 that extends between the tabs 31, 35 and between the two tank tabs 31. Abutment edge 39 has the same curved configuration as interior walls 41 of the assembled header and tanks 15, 17. Baffle plate 29 is dimensioned so that abutment edge 39 will create an interference fit with the interior walls 41. The interference fit is illustrated by the dotted lines in FIG. 4. The interference fit is preferably in a range from 0.01 mm 0.5 mm. That is, if one measures from one side of abutment edge 39 to an opposite side, at any particular point, then it will be 0.01 to 0.5 mm greater in dimension than the same measurement of header and tank assembly 13 interior walls 41. The abutment edge 39 thus will circumscribe an area that is oval shaped and slightly greater than the oval shaped flow area defined by the interior walls 41 of header and tank assembly 13. The interference fit causes deformation of the interior walls 41, imbedding the abutment edge 39 slightly into the interior walls 41 as illustrated in FIG. 5.

Figure 3:
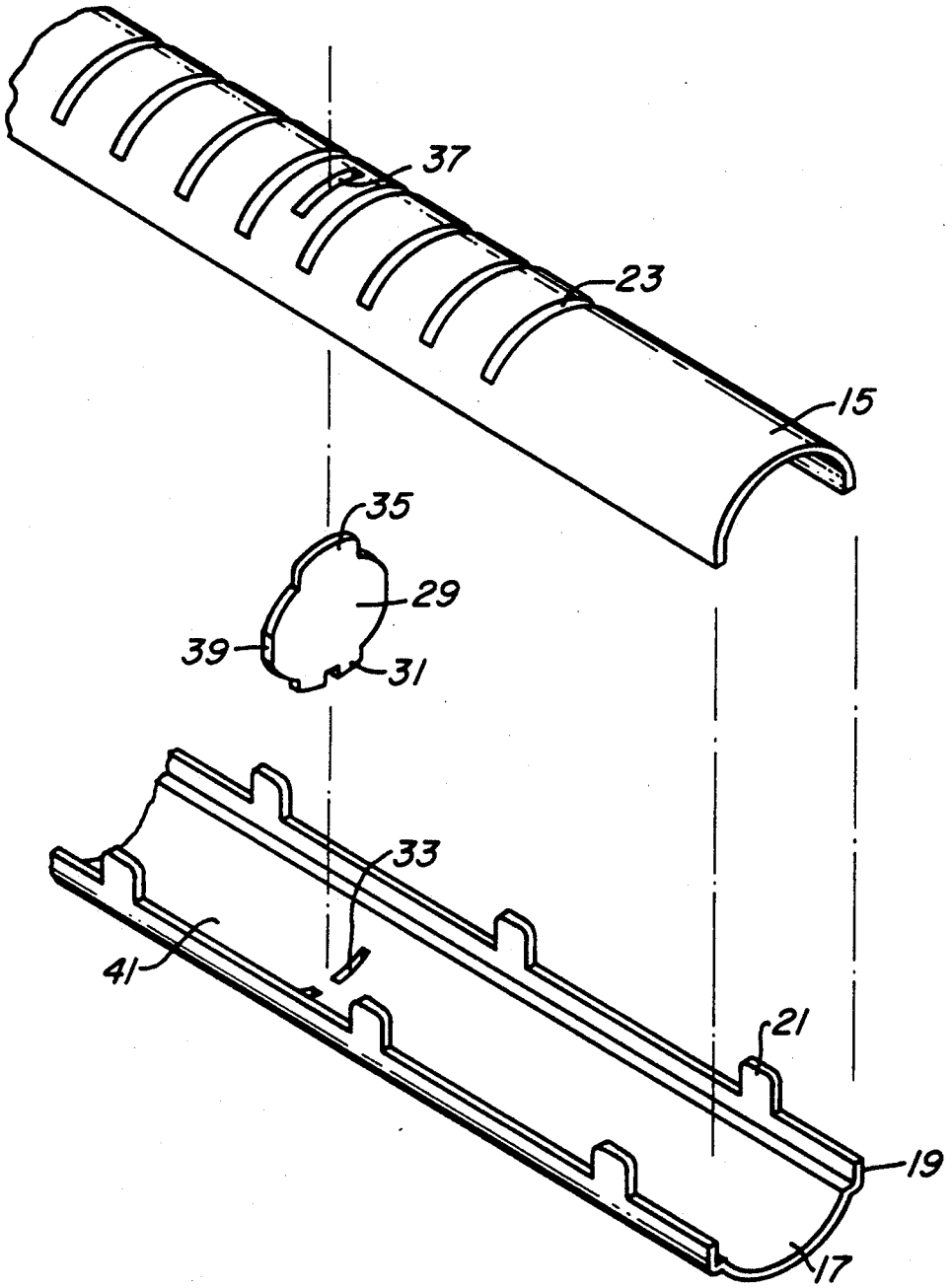
FIG. 3 is another exploded perspective view of the header and tank assembly of FIG. 2, but showing the header and tank assembly from an opposite side.

To assembly condenser 11, the assembler will form the header 15 and tank 17 as illustrated in FIG. 3. Tube slots 23 and header plate slots 37 will be pierced in the header 15. Tank plate slots 33 will be pierced in the tank 17. The interior walls 41 may be otherwise smooth and free of any gutters or recesses as in the prior art.

The tabs 31, 35 and abutment edges 39 of each baffle plate 29 could be coated with a brazing material. The assembler inserts the baffel plates 29 into either the header 15 or the tank 17. Assuming the baffel plates 29 are first inserted into the tank 17, the tank tabs 31 will engage the tank plate slots 33. The tank 17 will be placed in one half of a die (not shown). Once all of the baffle plates 29 are positioned in the tank 17, the assembler then brings the header 15 over into engagement. The header plate slots 37 will receive the header tabs 33.

The assembler then places the other die half over the die half that is holding the tank 17. The assembler brings the die halves together with sufficient force to cause the abutment edges 39 to deform the interior walls 41 as illustrated in FIG. 5. The tabs 21 are bent over to hold the assembly in place.

The assembler stacks an assembly of fins 27 and tubes 25 into a fixture. Then, the assembler places a header and tank assembly 13 on each side of the stacked fins 27 and tubes 25 and forces the header and tank assemblies toward each other, inserting the ends of the tubes 25 into the tube slots 23. The ends of the tubes 25 may also have a brazing compound contained on them. The assembler will place the entire assembly in a brazing furnace, which brazes the various components together.

The invention has significant advantages. By utilizing an oversized baffle plate in an interference fit, the interior recesses or gutters may be eliminated. Sealing is accomplished by embedding the abutment edges into the interior walls of the headers. This reduces the expense of the condenser. By utilizing an interference fit, if brazing does not occur sufficiently, bypass leaks are minimized. Reducing bypass leaks avoids a loss in performance.

While the invention has been shown in only one of its forms, it should be apparent to those skilled in the art that it is not so limited, but is susceptible to various changes without departing from the scope of the invention. For example, the end caps on the ends of the headers could be installed with plates having an interference fit in the same manner as the baffle plates shown.

We claim:

1. In a heat exchanger having a plurality of parallel tubes extending between a pair of header and tank assemblies, each header and tank assembly having a header portion and a tank portion which are joined together with interior walls of the header portion and tank portion defining a flow area, the header portion having a plurality of tube slots for receiving ends of the tubes to flow refrigerant between the header and tank assemblies and the tubes, the improvement comprising in combination:

at least one flow blocking plate located in at least one of the header and tank assemblies, each plate being flat and having an outer abutment edge which abuts and deforms the interior walls of the header portion and tank portion in an interference fit when the header portion and tank portion are joined together, the deformation of the interior walls of the header portion and tank portion enhancing sealing of the abutment edge to the interior walls.

2. In a heat exchanger having a plurality of parallel tubes extending between a pair of header and tank assemblies, each header and tank assembly having a header portion and a tank portion which are joined together with interior walls of the header portion and tank portion defining a flow area, the header portion having a plurality of tube slots for receiving ends of the tubes to flow refrigerant between the header and tank assemblies and the tubes, the improvement comprising in combination:

at least one flow blocking plate located in at least one of the header and tank assemblies, each plate having an outer abutment edge which abuts the interior walls of the header portion and tank portion in an interference fit, causing deformation of the interior walls of the header portion and tank portion to enhance sealing of the abutment edge to the interior walls; and wherein at least one of the header portions and tank portions has a plate slot extending therethrough, and wherein at least one of the plates has a tab extending past its abutment edge for entering the plate slot.

3. In a heat exchanger having a plurality of parallel tubes extending between a pair of header and tank assemblies, each header and tank assembly having a header portion and a tank portion which are joined together with interior walls of the header portion and tank portion defining a flow area, the header portion having a plurality of tube slots for receiving ends of the tubes to flow refrigerant between the header and tank assemblies and the tubes, the improvement comprising in combination:

at least one flow blocking plate located in at least one of the header and tank assemblies, each plate having an outer abutment edge which abuts the interior walls of the header portion and tank portion in an interference fit, causing deformation of the interior walls of the header portion and tank portion to enhance sealing of the abutment edge to the interior walls; and wherein the abutment edge of the plate circumscribes an area that is greater than the flow area of the header and tank assembly.

4. In a heat exchanger having a plurality of parallel tubes extending between a pair of header and tank assemblies, each header and tank assembly having a header portion and a tank portion which are joined together with interior walls of the header portion and tank portion defining a flow area, the header portion having a plurality of tube slots for receiving ends of the tubes to flow refrigerant between the header and tank assemblies and the tubes, the improvement comprising in combination:

at least one flow blocking plate located in at least one of the header and tank assemblies, each plate having an outer abutment edge which abuts the interior walls of the header portion and tank portion in an interference fit, causing deformation of the interior walls of the header portion and tank portion to enhance sealing of the abutment edge to the interior walls; and wherein each of the header and tank portions has a plate slot positioned to align with each other when the header and tank portions are joined together, and wherein at least one of the plates has a plurality of tabs extending past its abutment edge for entering the plate slots.

5. In a heat exchanger having a plurality of parallel tubes extending between a pair of header and tank assemblies, each header and tank assembly having a header portion and a tank portion which are joined together with interior walls of the header portion and tank portion defining a flow area, the header portion having a plurality of tube slots for receiving ends of the tubes to flow refrigerant between the header and tank assemblies and the tubes, the improvement comprising in combination:

at least one flow blocking plate located in at least one of the header and tank assemblies, each plate having an outer abutment edge which abuts the interior walls of the header portion and tank portion in an interference fit, causing deformation of the interior walls of the header portion and tank portion to enhance sealing of the abutment edge to the interior walls; and wherein the flow area is generally oval shaped.

6. In a heat exchanger having a plurality of parallel tubes extending between a pair of header and tank assemblies, each header and tank assembly having a header portion and a tank portion which are joined together, with interior walls of the header and tank assembly and tank portion defining a conduit for refrigerant flow, the header portion having a plurality of tube slots for receiving ends of the tubes to flow refrigerant between the header and tank assemblies and the tubes, the header portion and the tank portion each having at least one plate slot, the plate slots axially aligning with each other when the header portion and tank portion are joined together, the improvement comprising in combination:

at least one plate located in at least one of the header and tank assemblies for blocking refrigerant flow, each plate having a plurality of tabs, each of which inserts into one of the plate slots, each plate having abutment edges at its perimeter extending between the tabs which abut the interior walls of the header and tank portions in an interference fit, causing deformation of the interior walls of the header and tank portions to enhance sealing of the abutment edges to the interior walls.

7. The heat exchanger according to claim 6 wherein the dimensions across the plate from one side of the abutment edge to an opposite side are greater by an amount in the range from 0.01 mm to 0.5 mm than the corresponding dimensions across the interior walls.

8. The heat exchanger according to claim 6 wherein the header and tank assembly is generally oval in configuration.

9. In a method of assembling a heat exchanger header and tank assembly, which includes providing a tank portion and a header portion which have interior walls when assembled together define a flow area, and forming tube slots in the header portion, the improvement comprising:

providing at least one baffle plate having an abutment edge which circumscribes an area that is larger than the flow area of the header and tank assembly;

inserting the plate into one of the portions; then assembling the tank portion and header portion in engagement with each other with the plate located therein, and pressing the portions together with sufficient force to cause the abutment edge of the plate to deform the interior walls slightly to enhance sealing between the plate and the interior walls.

10. The method according to claim 9 wherein the method further comprises:

providing at least one of the portions with a plate slot; and providing at least one of the plates with a tab extending past its abutment edge; then inserting the tab into the plate slot while inserting the plate into one of the portions.

11. The heat exchanger according to claim 9 wherein the method further comprises:

providing each of the portions with a plate slot;

providing the plate with a plurality of tabs extending past its abutment edge for entering the plate slots; then inserting the tabs into the plate slots while inserting the plate into one of the portions and while assembling the portions together.

12. In a method of assembling a heat exchanger, which includes providing a tank portion and a header portion which have interior walls when assembled together define a flow area, and forming tube slots in the header portion, the improvement comprising:

providing each of the portions with a plate slot;

providing at least one baffle plate having an abutment edge which circumscribes an area that is larger than the flow area of the header and tank assembly;

providing the plate with a plurality of tabs extending past its abutment edge for entering the plate slots; then inserting the plate into one of the portions, with one of the tabs locating within one of the plate slots; then assembling the tank portion and header portion in engagement with each other with the plate located therein, and locating another of the tabs in the other of the plate slots;

pressing the assembled portions together with sufficient force to cause the abutment edge of the plate to deform the interior walls slightly to enhance sealing between the plate and the interior walls; then clamping the assembled portions together; then inserting tubes into the tube slots.

* * * * *